US008978278B1

(12) United States Patent
Rossi

(10) Patent No.: US 8,978,278 B1
(45) Date of Patent: Mar. 17, 2015

(54) TOOTHBRUSH IDENTIFIER

(76) Inventor: Martin Rossi, Hollywood, FL (US)

( * ) Notice: Subject to any disclaimer, the term of this patent is extended or adjusted under 35 U.S.C. 154(b) by 269 days.

(21) Appl. No.: 13/445,449

(22) Filed: Apr. 12, 2012

(51) Int. Cl.
*G09F 3/00* (2006.01)
*A46B 15/00* (2006.01)

(52) U.S. Cl.
CPC ..... *A46B 15/00* (2013.01)
USPC ..... 40/314; 40/501

(58) Field of Classification Search
USPC ..... 40/661.12, 501, 314; 116/315
See application file for complete search history.

(56) References Cited

U.S. PATENT DOCUMENTS

| | | | | |
|---|---|---|---|---|
| 1,155,878 | A | 10/1915 | Booth | |
| 1,211,468 | A | 1/1917 | McLean | |
| 1,380,633 | A | 6/1921 | Brown | |
| 1,558,970 | A | 10/1925 | Exline | |
| 2,016,644 | A | 10/1935 | Luball | |
| 2,489,707 | A | 11/1949 | Eubanks | |
| 4,589,159 | A | 5/1986 | Streibel | |
| 5,280,834 | A * | 1/1994 | Berkley | 206/5.1 |
| D397,253 | S | 8/1998 | Satterfield | |
| D448,175 | S | 9/2001 | Shurney | |
| 7,415,788 | B2 | 8/2008 | Little et al. | |
| 2004/0139569 | A1 | 7/2004 | Chen | |
| 2005/0044646 | A1 | 3/2005 | Peretz et al. | |
| 2009/0173346 | A1 * | 7/2009 | Stuart et al. | 128/203.12 |
| 2011/0224060 | A1 * | 9/2011 | Crosby | 493/84 |

* cited by examiner

*Primary Examiner* — Joanne Silbermann
(74) *Attorney, Agent, or Firm* — Robert C. Montgomery; Montgomery Patent & Design

(57) ABSTRACT

A toothbrush has an integral identification system for distinguishing one (1) toothbrush from another. At the bottom of the toothbrush handle is a cylinder and rotating thumb wheel assembly. The cylinder has a plurality of indicia which are visible one (1) at a time through a window on the side of the brush handle. A user rotates the thumb wheel to display an individual indicium. Once selected, a locking pin mechanism prevents the cylinder from being accidentally turned. These features allow multiple users to distinguish their toothbrush from another's by verifying the displayed indicia. Alternative embodiments can be retrofit and/or replaced on a toothbrush handle.

9 Claims, 5 Drawing Sheets

TOOTHBRUSH IDENTIFIER

RELATED APPLICATIONS

There are currently no applications co-pending with the present application.

FIELD OF THE INVENTION

The presently disclosed subject matter is directed towards oral hygiene devices. More particularly, the present invention relates to identifiers for toothbrushes.

BACKGROUND OF THE INVENTION

The benefits of brushing one's teeth are well known to all. Brushing removes food particles and plaque on one's teeth while keeping one's mouth and breath fresh. The common toothbrush is a great tool for performing such a task provided that it is periodically replaced. However, it is during this replacement that confusion often results, especially in bathrooms with multiple users. Spouses, siblings and other relatives typically share a common spot to store all of their toothbrushes. As the various toothbrushes are replaced and colors of the toothbrushes are changed, it is a common occurrence to use someone else's toothbrush by mistake. Not only is such action unsavory on the part of both people, but such action can spread disease and illness as well.

Accordingly, there exists a need for a means by which one's own toothbrush can be easily identified amongst others in order to avoid using the wrong toothbrush.

SUMMARY OF THE INVENTION

The principles of the present invention provide for a toothbrush identifier which provides a toothbrush with an integral but changeable identification system useful for identifying one's toothbrush from others.

The present invention is a toothbrush having a conventional plastic handle and a conventional bristle head. The lower portion of the handle is provided with a cylinder that rotates around the exterior of the toothbrush handle. The cylinder includes indicia such as sequential numbers, letters, graphic symbols or the like which are visible, one at a time, through a vision window on the side of the brush handle. A user can set the indicia when removing the toothbrush from its packaging. Once set, a detent mechanism prevents it from accidentally turning. These features allow multiple users, even those with the same color and style of toothbrush, to easily determine their toothbrush from others by verifying their selected number, letter, or graphic symbol. At the end of its useful life, the invention is simply discarded and a new one takes its place.

BRIEF DESCRIPTION OF THE DRAWINGS

The advantages and features of the present invention will become better understood with reference to the following more detailed description and claims taken in conjunction with the accompanying drawings in which like elements are identified with like symbols and in which:

DESCRIPTIVE KEY

Figure 1:
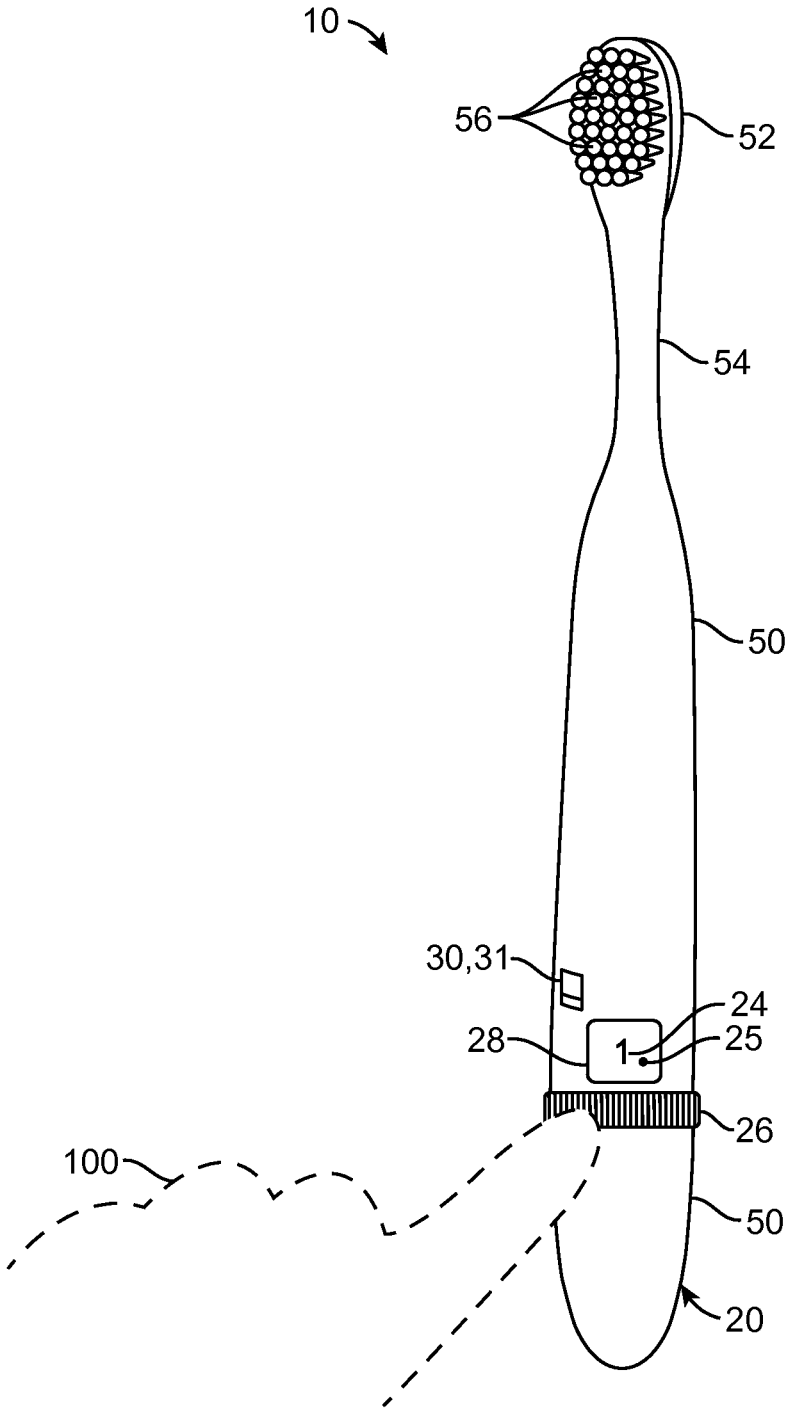
FIG. 1 is a front view of a toothbrush with identifier mechanism 10 according to a preferred embodiment of the present invention.

10 toothbrush with identifier mechanism
20 identification mechanism
24 indicia
25 Braille feature
26 thumb wheel
28 viewing aperture
30 locking pin
31 slot
32 cylinder
34 locking aperture
36 post
37 horizontal portion
38 vertical portion
50 handle
52 head
54 neck
56 bristle bundle
100 user
120 threaded identification mechanism
122 male threaded region
150 replaceable handle
154 female threaded region
220 retrofittable identification mechanism
222 friction boot
250 existing toothbrush

DETAILED DESCRIPTION OF THE PREFERRED EMBODIMENT

Figure 2:
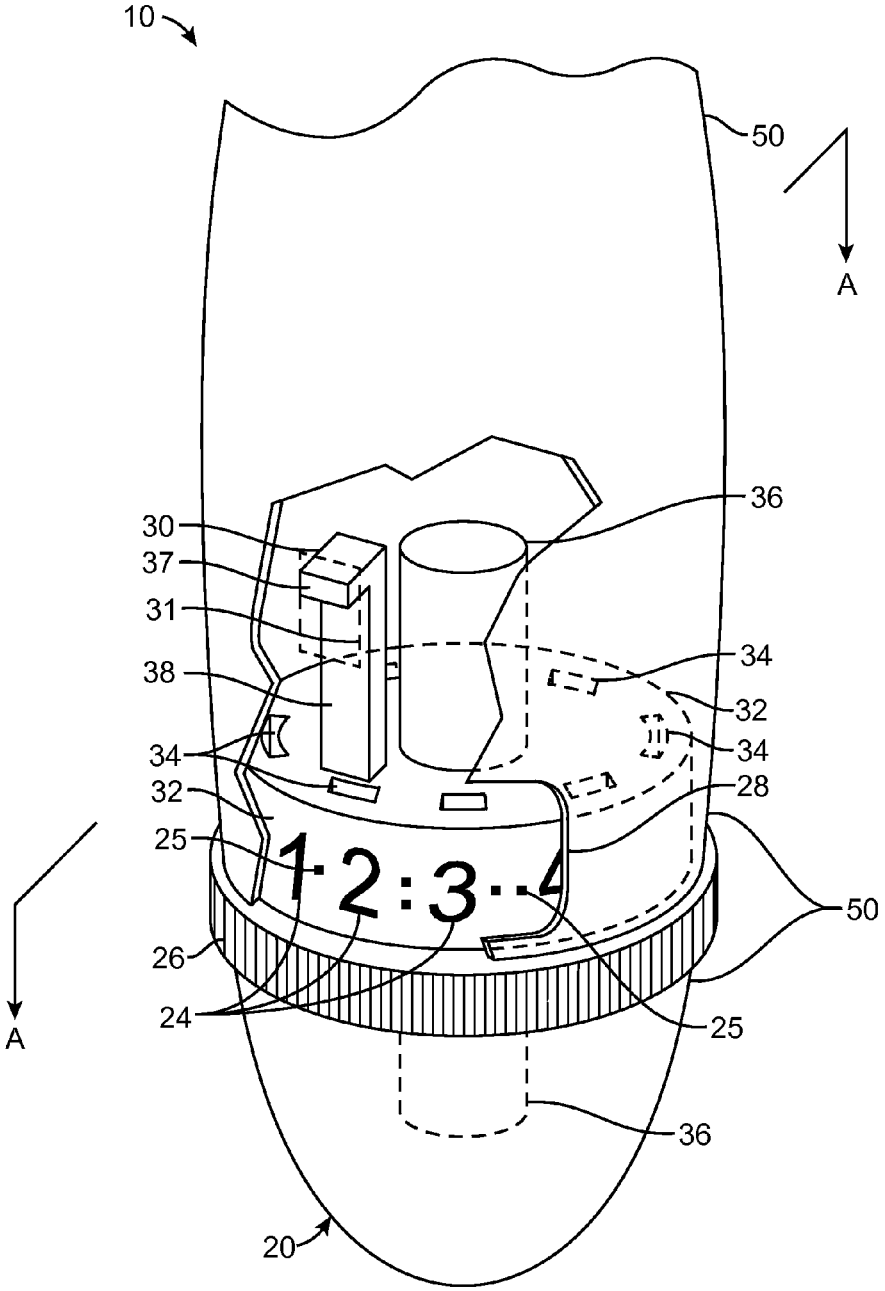
FIG. 2 is a partial cut-away view of the toothbrush with identifier mechanism 10 shown in FIG. 1.
Figure 3:
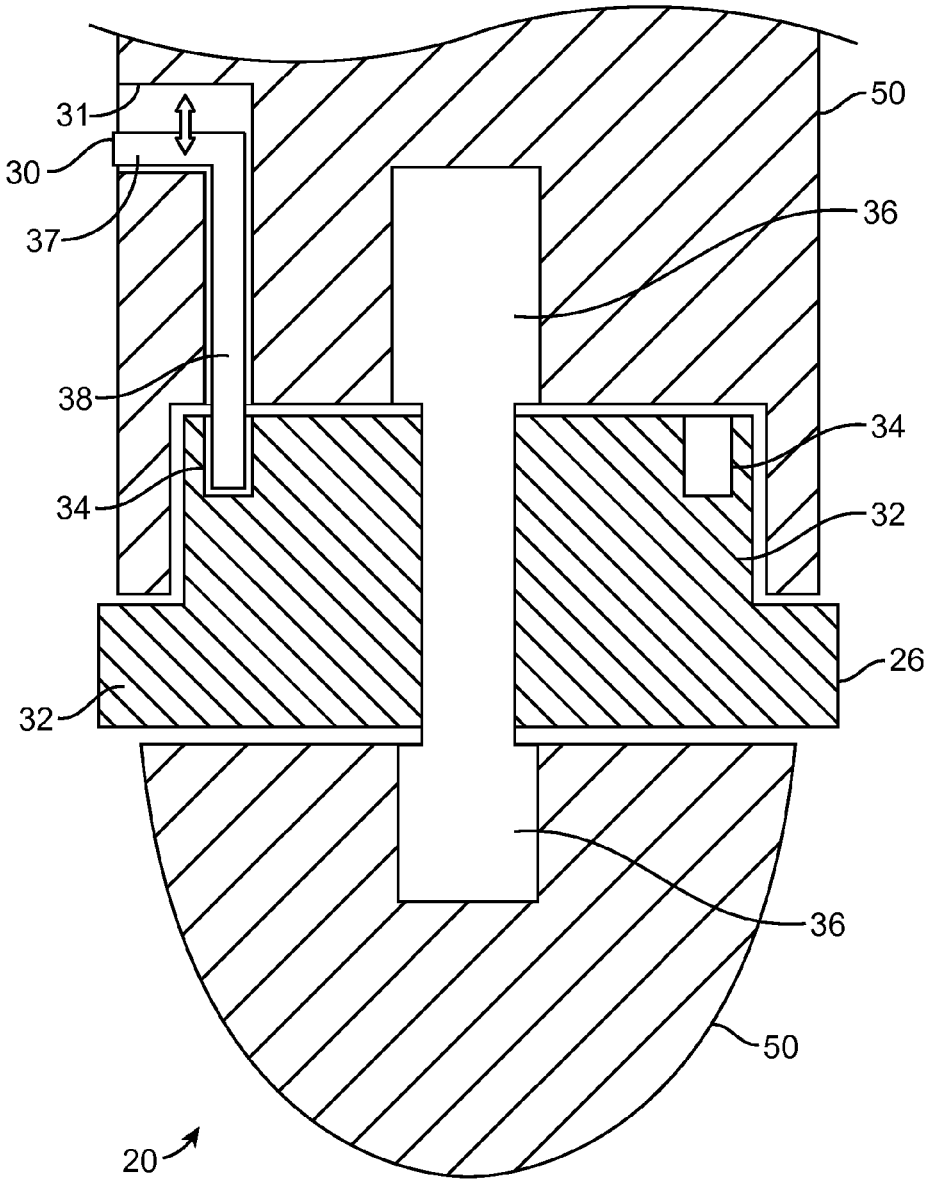
FIG. 3 is a section view taken through a locking mechanism 20 of the toothbrush with identifier mechanism 10 shown in FIG. 1 and FIG. 2.
Figure 4:
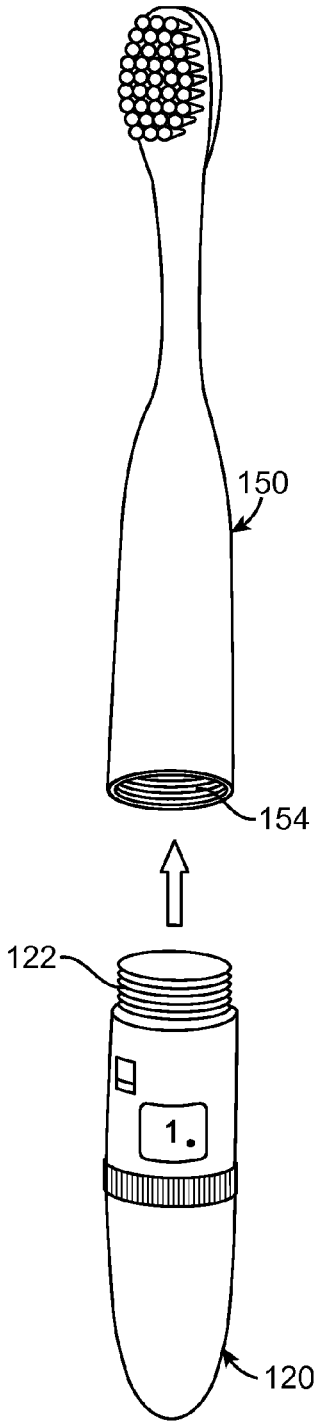
FIG. 4 is a front view showing a threaded identification mechanism 120 according to an alternate embodiment of the present invention; and, FIG. 5 is a front view of a retrofittable identification mechanism 250 according to another alternate embodiment of the present invention.
Figure 5:
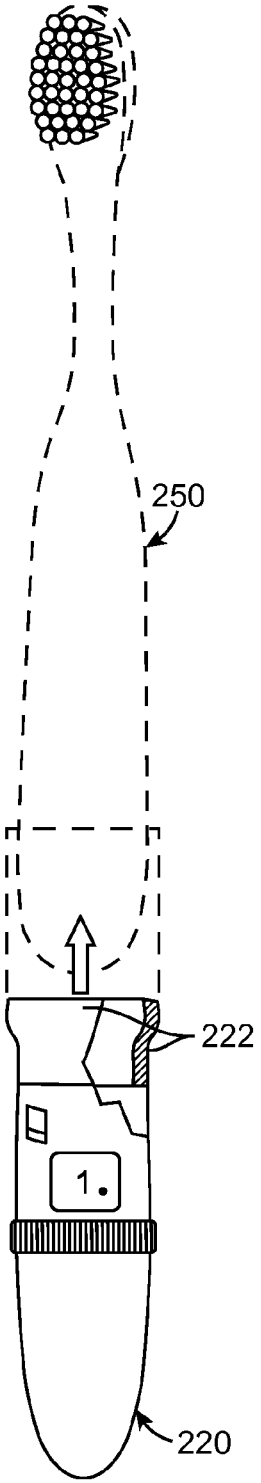

The best mode for carrying out the invention is presented in terms of its preferred embodiment, is depicted in FIGS. 1 through 3 and alternate embodiments are shown in FIG. 4 and FIG. 5, and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention relates to a toothbrush 10 having a mechanism that identifies an individual user's 100 personal toothbrush from others. The features of the toothbrush 10 allow multiple users 100, even those utilizing toothbrushes with an identical color and/or style, to easily identify their own toothbrush via individually selected indicium 42.

Refer now to FIG. 1, which is a front view of the toothbrush 10 according to a preferred embodiment of the present invention. The toothbrush 10 functions similar to a conventional toothbrush. It has a plastic handle 50 that tapers down along a slightly angular plastic neck 54 to a head 52 with a plurality of embedded bristle bundles 56. It should be understood that the toothbrush 10 may take the form of a variety of different toothbrush styles having different shaped handles 50, various colors and patterns, differently sized and shaped heads 52, various patterns of bristles 56, and the like, without deviating from the teachings of the invention. Therefore, the embodiment illustrated in FIG. 1 should not be interpreted as a limiting factor of the toothbrush 10.

Referring now to FIG. 1 and FIG. 2, the toothbrush 10 includes an integral identification mechanism 20 that is integrated into a lower portion of the handle 50. The integral identification mechanism 20 comprises an internal cylinder 32 that can be selectively rotated via an integrally-molded thumb wheel 26. The cylinder 32 has a plurality of unique molded-in and protruding indicium 24 that are envisioned as comprising sequential numerals which range from one (1) to ten (10) or some other such identification. Each indicium 24 may be individually observed one (1) at a time through a stationary viewing aperture 28 that is located along a front surface of the handle 50.

The indicia 24 are envisioned as being accompanied by corresponding molded-in Braille features 25, thereby enabling blind or visually impaired individuals to utilize the toothbrush 10 or to allow use in low light levels. It is understood that the indicia 24 may also comprise other symbols such as, but not limited to: sequential letters, graphic symbols, or the like, and as such should not be interpreted as a limiting factor of the toothbrush 10.

Referring now to FIGS. 2 and 3, respectively partial cutaway and section views of the locking mechanism 20. A user 100 rotates the thumb wheel 26 to select a specific indicium 24. Once the indicium 24 is selected, a locking mechanism 30 prevents the cylinder 32 from being rotated and the selected indicium 24 from being accidentally changed.

The locking mechanism 20 provides a mechanism to select and lock a particular indicium 24 in place to be viewed through the viewing aperture 28 for unique identification of a user's 100 toothbrush. The locking mechanism 20 uses the thumb wheel 26, the viewing aperture 28, a locking pin 30, a slot 31, the cylinder 32, and a locking aperture 34. The bottom of the handle 50 comprises a round cross-section containing the cylinder 32, which is rotated around a vertical post 36 that is located inside the handle 50 along a vertical centerline.

The post 36 has a "dumbbell" shape with a recessed center section onto which the cylinder 32 rotates. The cylinder 32 includes the thumb wheel feature 26 which extends around a lower surface of the handle 50 and a plurality of equally-spaced locking apertures 34 that are arranged along an upper surface of the cylinder 32. The apertures 34 enable locking the cylinder 32 in position via engagement of the locking pin 30. The thumb wheel 26 protrudes outwardly slightly beyond the outer surface of the handle 50. It is envisioned that the post 36 and the cylinder 32 provide "clicking" features or a slight relative friction to provide a slight resistance to turning, thereby providing a user 100 with a degree of rotational control during selection and locking of the desired indicium 24. The thumb wheel 26 beneficially has a knurled surface to enable easy rotation of the cylinder 32 to select a desired indicium 24 to be viewed in the aperture 28.

The locking pin 30 is an inverted "L"-shaped member that is positioned in and guided along a slot 31 in the outer surface of the handle 50. The "L"-shaped locking pin 30 can take a horizontal portion 37 and a vertical portion 38. The horizontal portion 37 provides a small sliding feature that is flush with the outer surface of the handle 50 to allow a user 100 to move the locking pin 30 vertically to selectively lock or release the rotary motion of the cylinder 32. With the locking pin 30 raised; the cylinder 32 can be rotated using the thumb wheel 26 to move a desired indicium 24 into the aperture 28. Sliding the locking pin 30 down by moving the horizontal portion 37 down results in engagement of the vertical portion 38 with one of the locking apertures 34 of the cylinder 32. Such engagement corresponds to the desired indicium 24 being located in the aperture 28.

Referring now to FIG. 4, which is a front view of an alternate threaded identification mechanism 120 that enables replacement of a handle 150. Such an identification mechanism 120 can greatly extend the useful life of the threaded identification mechanism 120. The alternate threaded identification mechanism 120 is similar in construction and functionality to the previously described preferred identification mechanism 20; however, the threaded identification mechanism 120 has a male threaded region 122 along an upper edge. This male threaded region 122 enables periodic replacement of the handle 150 having a mating female threaded region 154 when the handle portion 150 becomes worn.

FIG. 5 presents a front view of a retrofit identification mechanism 220 that is in accord with yet another embodiment of the present invention. The retrofit identification mechanism 220 provides a mechanism for attachment to an existing toothbrush 250 via an integral friction boot 222 that is located along a top edge. The retrofit identification mechanism 220 is similar in construction and functionality to the previously described preferred identification mechanism 20; however, the retrofit identification mechanism 220 has the friction boot 222 which is a flexible tubular rubber or latex appendage that protrudes up from an upper end. The friction boot 222 is capable of being stretched and inserted over a bottom end of an existing toothbrush 250. The retrofit identification mechanism 220 provides a means of repeated usage on a plurality of toothbrushes 250, thus extending the useful life of the retrofit identification mechanism 220.

It is envisioned that other styles and configurations of the present invention can be easily incorporated into the teachings of the present invention, and while only three particular configurations are shown and described for purposes of clarity and disclosure such is not by way of limitation of scope.

The preferred embodiment of the present invention can be utilized by the common user in a simple and effortless manner with little or no training. After initial purchase or acquisition of the device 10, it would be configured as in FIG. 1. The method of utilizing the preferred embodiment of the device 10 may be achieved by performing the following steps: procuring a model of the device 10 having a desired shaped, color handle 50, head 52 size, pattern of bristles 56, and the like; selecting a desired indicium 24 by sliding the locking pin 30 upward using a fingernail or small tool; rotating the cylinder 32 using the thumb wheel 26 until observing a desired indicium 24 within the viewing aperture 28; sliding the locking pin 30 down to lock the position of the cylinder 32 and selected indicium 24; using the device 10 in a similar manner as a normal toothbrush; and benefiting from individual identification of a user's 100 toothbrush.

The method of using the alternate embodiment threaded identification mechanism 120 is as follows: using the threaded identification mechanism 120 and attached replaceable handle 150 in a similar manner to a normal toothbrush until the replaceable handle 150 is worn; removing the replaceable handle 150 by unscrewing the male 122 and female 154 threaded regions; screwing the threaded identification mechanism 120 onto a new handle 150; selecting and securing the desired indicium 24 as described above; and, resuming normal use of the alternate threaded embodiment 120, 150.

The method of utilizing the alternate retrofittable identification mechanism 220 is as follows: using the retrofittable identification mechanism 220 and existing toothbrush 250 in a similar manner as a normal toothbrush until the existing toothbrush 250 is worn and needs to be replaced; removing the existing toothbrush 250 by stretching the friction boot 222 of the retrofittable identification mechanism 220 out and removing the worn existing toothbrush 250; inserting the retrofittable identification mechanism 220 on a bottom handle of a new toothbrush 250; selecting and securing the desired indicium 24 as described above; and, resuming normal use of the alternate retrofittable embodiment 220, 250.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A toothbrush, comprising:

a handle having a vertical post extending along a centerline, and a horizontal portion and a vertical portion that form a "L" shaped slot within said handle;

an integral identification mechanism having a cylinder with a plurality of indicia and a plurality of vertically extending apertures and which rotates on said vertical post, said identification mechanism for selecting one indicium from said plurality of indicia;

an "L" shaped locking pin within said "L" shaped slot;

a head having a plurality of toothbrush bristles; and, a neck connecting said handle to said head;

wherein said "L" shaped locking pin selectively engages with a selected aperture of said vertically extending apertures to prevent said cylinder from turning.

2. The toothbrush according to claim 1, wherein said identification mechanism further includes a viewing aperture for viewing said indicium.

3. The toothbrush according to claim 2, wherein said viewing aperture is located on a front surface of said handle.

4. The toothbrush according to claim 1, wherein said cylinder further includes a user accessible thumb wheel for selecting said indicium.

5. The toothbrush according to claim 4, wherein said identification mechanism further includes a locking mechanism that prevents said cylinder from being rotated and said indicium from being changed.

6. The toothbrush according to claim 4, wherein said thumb wheel has a knurled surface.

7. The toothbrush according to claim 1, wherein said identification mechanism is molded into said handle.

8. The toothbrush according to claim 1, wherein said plurality of indicia includes a sequence of numerals.

9. The toothbrush according to claim 1, wherein said plurality of indicia includes Braille features.

* * * * *